US005549448A

United States Patent [19]

Langston

[11] Patent Number: 5,549,448

[45] Date of Patent: Aug. 27, 1996

[54] VARIABLE STATOR VANE LINKAGE SYSTEM AND METHOD

[75] Inventor: Todd A. Langston, Chandler, Ariz.

[73] Assignee: United Technolgies Corporation, Hartford, Conn.

[21] Appl. No.: 385,414

[22] Filed: Feb. 8, 1995

[51] Int. Cl.[6] ..... F01D 17/16

[52] U.S. Cl. ..... 415/149.4; 415/150; 415/162; 29/889.2; 29/889.22

[58] Field of Search ..... 415/149.4, 150, 415/160, 162; 29/889.1, 889.2, 889.22

[56] References Cited

U.S. PATENT DOCUMENTS

| | | | |
|---|---|---|---|
| 3,314,595 | 4/1967 | Burge et al. | 415/160 |
| 4,755,104 | 7/1988 | Castro et al. | 415/160 |
| 5,190,439 | 3/1993 | Das | 415/149.4 |

*Primary Examiner*—James Larson
*Attorney, Agent, or Firm*—Norman Friedland

[57] ABSTRACT

The linkage system for the variable vane stators includes a pumphandle driven by the linear actuator and a cooperating pumphandle slider bracket where the slider bracket includes a machined hard coated stop for limiting travel of the pumphandle when the vanes are at the full opened position. The pumphandle through the drive link circumferentially positions a synchronizing ring that is connected through a plurality of drive links to each of the vanes circumferentially spaced in the stator for changing the angle of each of the vanes as scheduled by a control and actuator for optimizing the performance of the compressor and gas turbine engine. The steps for assembling the linkage system and actuator for synchronizing the positions of the stops on the actuator and slider bracket relative to a given position of the stator vanes defines a method for providing a rigless variable vane system.

10 Claims, 4 Drawing Sheets

VARIABLE STATOR VANE LINKAGE SYSTEM AND METHOD

This invention was made under a U.S. Government contract and the Government has rights herein.

TECHNICAL FIELD

This invention relates to gas turbine engines and particularly to the variable stator vane system and the means for orienting the mechanical linkages relative to the vanes and actuator and the method therefor.

BACKGROUND ART

As is well known in the gas turbine engine art, it is typical to include variable stator vanes in certain stages of compression in the compressor section. In order to enhance engine performance, reliability and power output, the angle of the vanes are varied to a particular schedule during the operating envelope. Compressor efficiency is maximized by orienting the angle of attack of the engine working fluid before flowing to the compressor blades of the compressor rotor. This requires angular changes of each of the vanes in a stator row of vanes. In order to effectuate this change, a unison or synchronizing ring (sync ring) by way of linkages is attached to each of the vanes and an actuator(s), scheduled by the engine control, through a stator linkage system including a pumphandle and slider bracket to mechanically position the sync ring(s).

U.S. Pat. No. 4,755,104 granted to J. H. Castro and R. S. Thompson on Jul. 5, 1988 entitled "Stator Vane Linkage" and assigned to United Technologies Corporation, the assignee common to this patent application, describes a typical variable stator vane system of the type which is a concern in this invention. As noted in this patent, adjustment of the individual vane is carried out by a mount rotatable about a radially oriented axis linking each blade of an individual stage together by a plurality of corresponding vane arms extending perpendicular to each axis of rotation for each blade. Each arm further being joined at the end thereof to the sync ring encircling the generally cylindrical compressor case and causing equal radial rotation in each linked stator vane in response to relative circumferential displacement between the unison ring and the compressor case.

Problems, particularly in maintenance, replacement of and the wear on the stator vane system, have occurred resulting in misscheduling of the stator vanes. In other words, when the linkages, components or actuators, are reassembled under the current rigging procedure (the procedure for setting the vane angle relative to the linkage and actuator) mischeduling problems have occurred where the angle of the vanes is no longer correlated to the input signal of the actuator. This problem is also a result occasioned from the wear of certain component parts of the stator linkage system.

To appreciate the problem, it is best to understand the rigging procedure for the heretofore known stator vane system design. A typical system consists of an external bellcrank that is actuated by an externally mounted hydraulic actuator. Generally an actuator mounted on the wall of the fan duct or the compressor case is connected to an externally mounted bell crank that, in turn, rotates an internal bellcrank through a torque shaft configuration. The internal bellcrank is connected to a pumphhandle by a link which rotates about a pivot bolt, and a slider bracket mounted to the engine case establishes the plane of rotation. The pumphandle, in turn, is connected to a series of sync rings through an equal number of links. A single engine will typically employ two of these systems equally spaced around the compressor.

What has been described immediately above is conventional and well known technology.

The procedure for rigging this assembly is as follows: The internal bell crank is rotated until a rigging hole in the pumphandle is aligned to a rigging hole in the slider bracket. A pin is temporarily inserted into the holes to hold the pumphandle in place relative to the slider bracket. An adjustable stop screw mounted on the slider bracket is then adjusted to contact with the pumphandle and locked down with a jam nut. At this point the rig pin is then removed. This now represents the rigged (open) position of the pumphandle, snyc rings and vanes. This procedure is repeated on the other side of the compressor. In installations where the actuator is affixed to a fan duct, the fan duct can now be installed and the external bellcrank is inserted through the fan duct and secured to the internal bellcrank. In other installations the actuator and external bellcrank are connected directly to the compressor case. In either embodiment, the final rigging procedure is to then torque the external bellcrank until the pumphandle contacts the set screw. The clevis of the actuator is then turned until it aligns with the external bellcrank (with the actuator fully retracted) and then bolted in place. Ideally, this would allow the actuator and pumphandle to contact their stops simultaneously.

As mentioned herein above, this system has evidenced problems occasioned by using the wrong size rigging pin, over torquing the stop screw (thus yielding the pumphandle), not contacting the pumphandle with the stop screw, over-torquing the external bellcrank (also yields the pumphandle), and a series of other human error mistakes all of which result in mischelduled variable vanes. Since the position of the vanes affects the angle of attack of the working fluid medium, the operation of the compressor is adversely affected.

I have found that I can obviate the problems noted above and eliminate the complex rigging procedure alluded to in the paragraph immediately above as well. In accordance with my invention, a fixed stop is machined on the slider bracket to which the pumphandle will contact when its at its correct rigging position. This creates a fixed rigging reference point and the rigging holes are thusly, eliminated. Since the contact areas on the pumphandle and slider bracket can be machined to the same tolerance as the rigging holes, there will be no increase in vane misposition due to manufacturing and assembling tolerances. The vanes will be set to their correct positions when the hardware is bolted to the case, and no further internal rigging is required.

Another problem that is evidenced in the heretofore known variable stator vane actuating systems is that as a result of the misrigging the contact stresses occasioned by the adjustable stop screw contacting the pumphandle prior to the actuator hitting its stop, continuing force of the actuator results in an significant over yield of the pumphandle. For the reasons enumerated above, the misrigging causes the stops on the actuator and pumphandle to become out of sync. Ideally, the stops should hit simultaneously if the system is rigged correctly. The problem is even further acerbated in a turbofan installation where the actuator is mounted on the fan duct. In this type of installation the thermal growth differences between the fan duct and the actuator causes the pumphandle to contact the stop screw prior to the actuator hitting its stop which causes compressive yielding of the pumphandle. Obviously, the problem compounds every time the actuator is removed for service without sliding the duct to rerig the system. When the actuator is reinstalled, the external bellcrank is torqued to where the stop screw contacts the pumphandle which is now displaced as a result of the yielding and the actuator clevis is adjusted to fit on the external bellcrank. The system is now misrigged and the wear/yielding cycle starts again. The heretofore known systems typically place a crown configuration on the contact portion of the stop screw which causes very high contact stresses when the pumphandle is loaded against the stop screw, resulting in pumphandle yielding. Attempts to obviate this problem by increasing the contact area of the stop screw/pumphandle so as to lower contact stresses, have been unsuccessful to prevent the yield problem.

This invention obviates this yield problem by making the width of the machined fixed stop of this invention sufficiently large so that the contact stresses are well within acceptable limits for both the pumphandle and slider bracket.

SUMMARY OF THE INVENTION

An object of this invention is to provide an improved adjustable stator vane for a gas turbine engine.

A feature of this invention is to provide for an adjustable stator vane a fixed stop mounted on the slider bracket that engages the pumphandle at a predetermined position in the operating envelope.

A feature of this invention is to provide a fixed stop on the slider bracket whose contact area with the pumphandle is sufficient so that the contact stresses are within acceptable limits for both the pumphandle and slider bracket.

This invention provides a method of rigging the variable stator vane system that is characterized as significantly reducing the assembly time in comparison to heretofore known systems.

The fixed stop of this invention is characterized by eliminating human error resulting in misscheduling of the vanes and minimizing system wear both of which will insure an accurate variable vane schedule for the life of the engine.

The foregoing and other features of the present invention will become more apparent from the following description and accompanying drawings.

DETAILED DESCRIPTION OF THE PREFERRED EMBODIMENT

While this invention is being described in its preferred embodiment as being incorporated on an axial flow turbofan gas turbine engine where the actuator and external bellcrank are mounted on the fan duct, it is to be understood, as one skilled in this art will appreciate, the invention can be employed with other types of turbofan engines where the actuator and external bell crank are mounted elsewhere, or for that matter in other types of gas turbine engines.

The invention includes the method of assembly to obtain a rigless variable vane system. The term rigless in the context of this invention means that once the mechanism excluding the actuator and external bellcrank of the system is adjusted and set (initial rigging), it requires no further rigging. This is in contrast to the heretofore known systems that require rigging after each maintenance and overhaul of the system.

Figure 1:
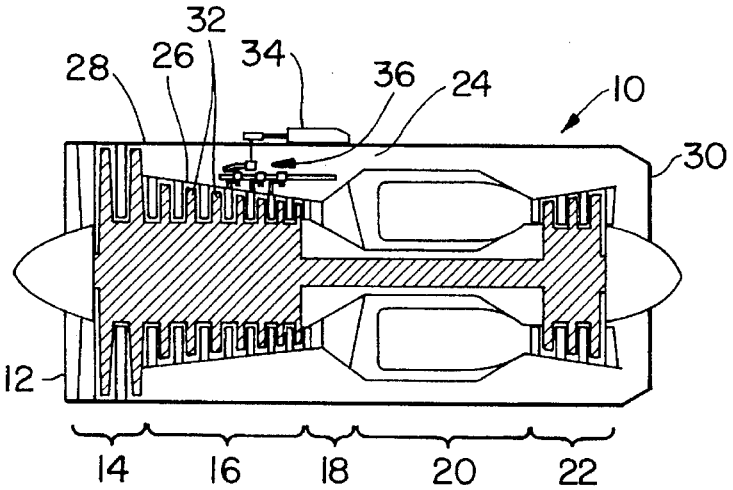
FIG. 1 (PRIOR ART)
FIG. 1 shows a schematic cross section of a prior art axial flow turbofan gas turbine engine.

Referring now to FIG. 1 which shows a schematic cross sectional arrangement of a typical axial flow turbofan gas turbine engine generally indicated by reference numeral 10 having an inlet 12 for admitting axially flowing air into a forward fan section 14. A portion of the air driven by the fan enters the gas generator, or hot core, comprised of a compressor section 16, diffuser section 18, a combustor section 20 and a turbine section 22. The air exiting the fan section 14 bypasses the gas generator and flows axially rearward through an annular bypass air passage 24 formed between the exterior of the compressor case 26 and a surrounding, coaxial fan duct 28. The hot core gases exiting the turbine section 22 and the bypass air both exit the engine outlet nozzle 30.

As is typical in the compressor section 16, the air passes through a number of axially arranged compressor stages each consisting of a row of stator vanes and a compressor rotor. Typically, some of the stator vanes are made to vary in order to maximize the angle of attack of the air entering into the adjacent blades of the compressor rotor.

Figure 2:
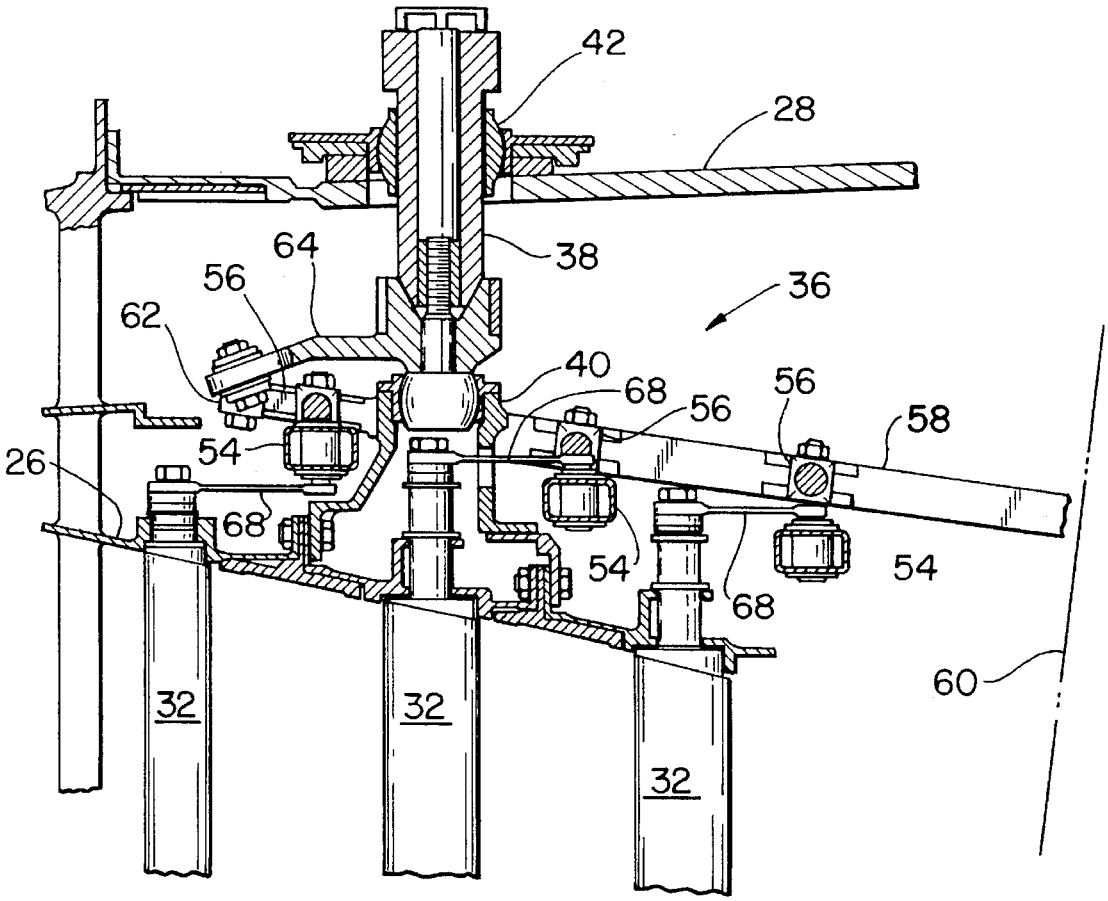
FIG. 2 (PRIOR ART)
FIG. 2 shows a partial cross sectional view of the prior art stator vanes and linkage taken in the plane of the engine's central axis.

As shown in FIG. 2 which is a cross section of three rows of variable stator vanes 32 with the compressor rotors removed that are varied by the linkage system generally indicated by reference numeral 36. As shown, a radially oriented torque shaft 38 is supported at the radially inward end by a spherical bearing 40 secured to the compressor case 26 and universal bearing 42 secured to the fan duct 28. Torque shaft 38 is free to rotate about its longitudinal axis and rotational motion is imparted thereto by a laterally extending drive arm 44 which is connected to the drive shaft 48 of drive actuator 34 (shown in FIG. 3). Linear actuator 34 supportably secured to fan duct 28 in the preferred embodiment is operable by hydraulics, but other mediums such as electrical or pneumatic may likewise be utilized. The rotational motion of the drive shaft 38 moves sync rings 54 by a linking means comprising a push rod 56 linking the sync ring 54 and a pivoted beam or pumphandle 58. Beam 58 is pivoted about an axis 60 radially oriented with respect to the generally cylindrical compressor case 26. The beam 58 is, in turn, linked to the torque shaft 38 by a drive link 62 disposed between the beam 58 and a laterally extending internal bellcrank 64 secured to the torque shaft 38 intermediate the compressor case 26 and fan duct 28.

Rotational motion of the torque shaft induced by the linear actuator 34 pivots beam 58 driving the unison ring 54 via the rings links 56. The circumferential movement of the sync ring 54 rotates the stator vanes 32 of an individual stator stage via the linking vane arms 68.

Figure 3:
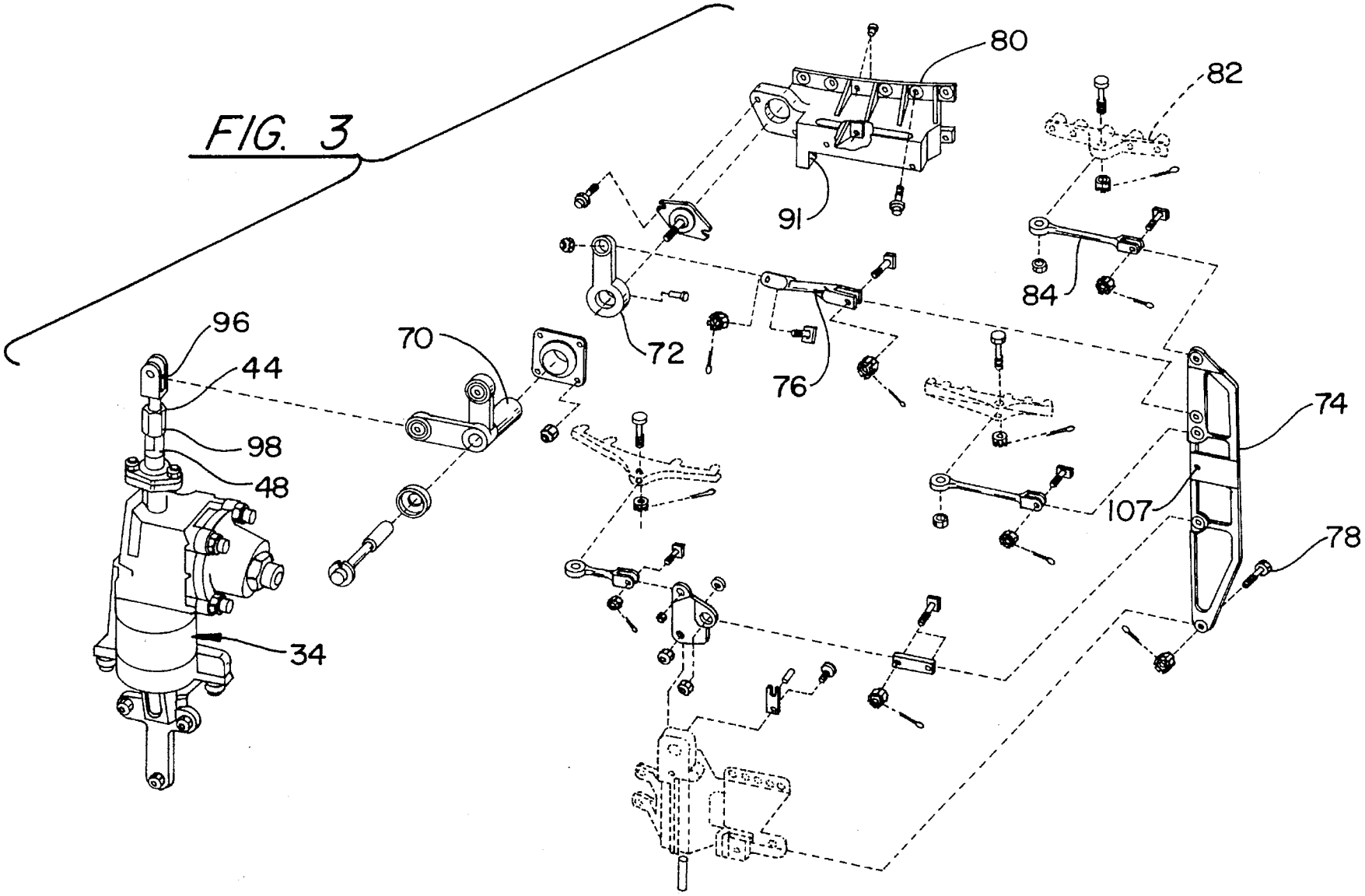
FIG. 3 is an exploded view of the stator vane linkage system.
Figure 4:
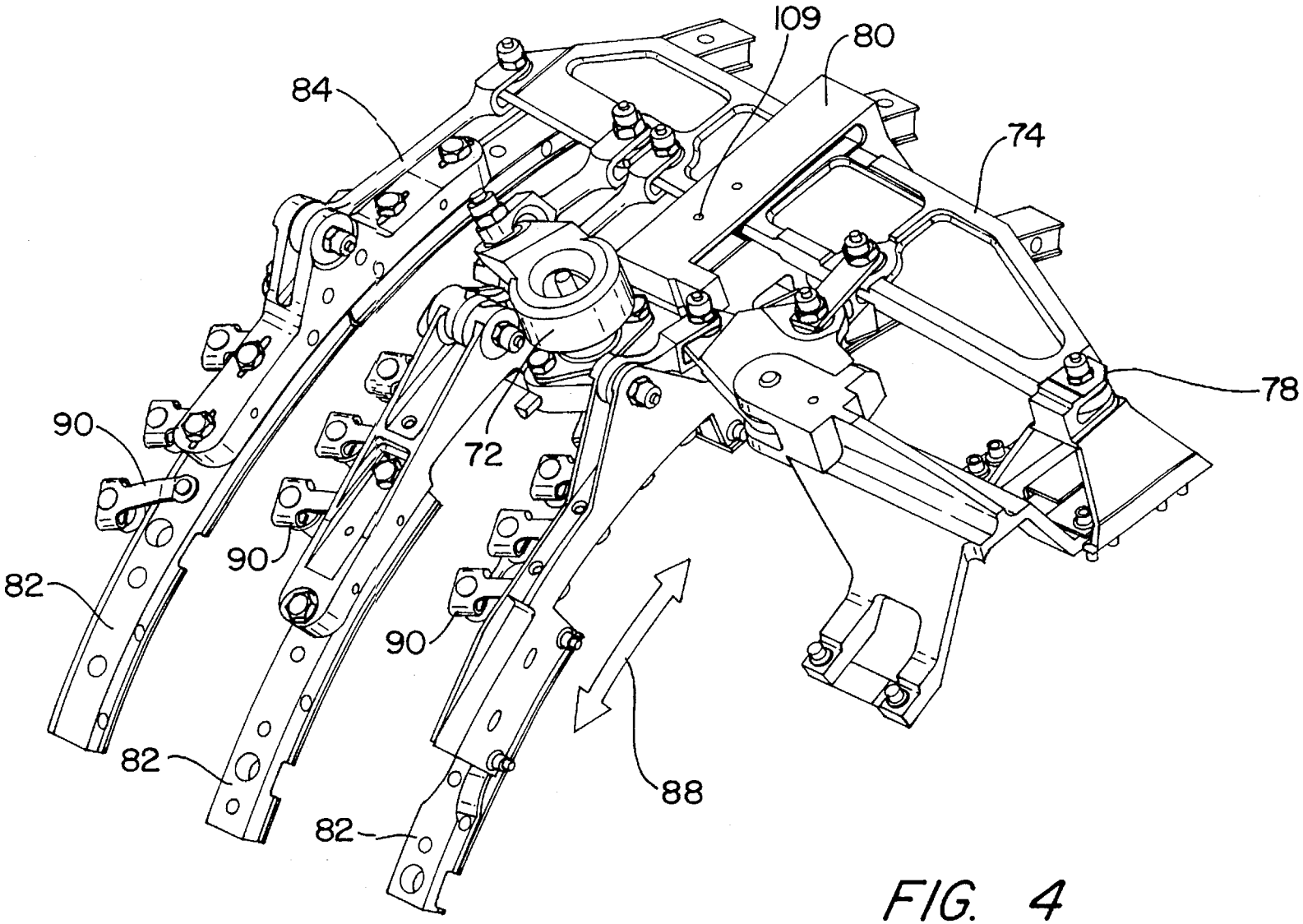
FIG. 4 is a partial perspective view of the stator vane linkage system of FIG. 3.

FIGS. 3 and 4 exemplify a modified stator vane actuation system that is used in the rear compressor variable vanes of a turbofan gas turbine engine that utilizes this invention. FIG. 3 is an exploded view and FIG. 4 is a partial perspective view showing the details of the stator vane actuation system. As noted the system consists of the external bellcrank 70 connected to the hydraulic actuator 34 (like reference numerals depict like elements in all the Figs.). The external bellcrank 70 is connected to the internal bellcrank 72 via the torque shaft configuration 38 (similar to that shown in FIG. 2). The internal bellcrank 72 is connected to the pumphandle 74 by link 76. Pumphandle 74 rotates about pivot bolt 78 and is disposed in pumphandle slider bracket 80. The slider bracket 80 establishes the plane of rotation. The pumphandle 74 in turn is connected to a series of sync rings 82 (only one being described for the sake of simplicity and convenience it being understood that the other two sync rings are substantially similar to the one being described). Sync ring 82 is connected to the end of pumphandle 74 by the drive link 84. Drive link 84 is suitably connected to the pumphandle and the sync ring 82 by suitable nut and bolt assemblies as shown in FIG. 3. A single engine will typically include two such mechanisms, as described, equally spaced around the compressor.

As is the case with the embodiment in FIG. 2, translation of the linear actuator 34 rotates the external bellcrank 70 which, in turn, through the torque shaft, rotates the internal bellcrank causing the pumphandle drive link 76 to pivot the pumphandle which, in turn, positions the sync ring 82 for circumferential movement 88. The movement is translated to each of the vanes 32 via the connecting links 90. As mentioned in the Background portion the linkages must be adjusted to schedule the position of the vanes to the input of the actuator 34. This is accomplished by the fixed stop mechanism shown in FIG. 5.

Figure 5:
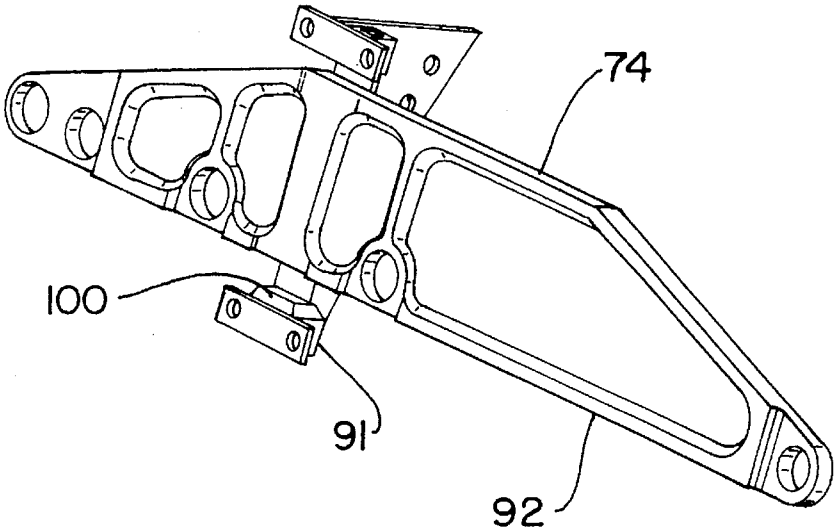
FIG. 5 is a partial view in elevation of the pump handle and a portion of the slider bracket illustrating the invention.

In accordance with this invention and shown in FIGS. 4 and 5 the slider bracket 80 is configured with a machined axial hard stop 100. In the preferred embodiment the contact area of stop 100 is hard coated with a suitable material such as nickle, chrome or their alloys or the like, by a well known coating technique such as plasma spray, ion vapor deposition or the like. The stop 100 that is machined on the inner face of extension 91 serves to abut against the front edge 92 of pumphandle at a central location. The method is to installing the linkage system and then to adjust the vanes to the wide open position and at this point the pumphandle engages the hard stop 100. Since the contact areas on the pumphandle and slider bracket can be machined to the same tolerances as the heretofore used rigging holes no increase vane misposition due to tolerances will be realized. The vanes will now be set to their correct positions when the hardware is bolted to the case. The actuator 34 is then attached by aligning the clevis 96 to fit into the arm of the external bellcrank 70 and the stop on the actuator is set by the collar 98.

From the foregoing it will be appreciated that when the stop of the pumphandle is set, the internal hardware is bolted to the case and the vanes will be set to their correct position and no further internal rigging is required for the life of the engine. This is in contrast to the heretofore systems where riggings are required after most maintenance and overhaul procedures.

Figure 6:
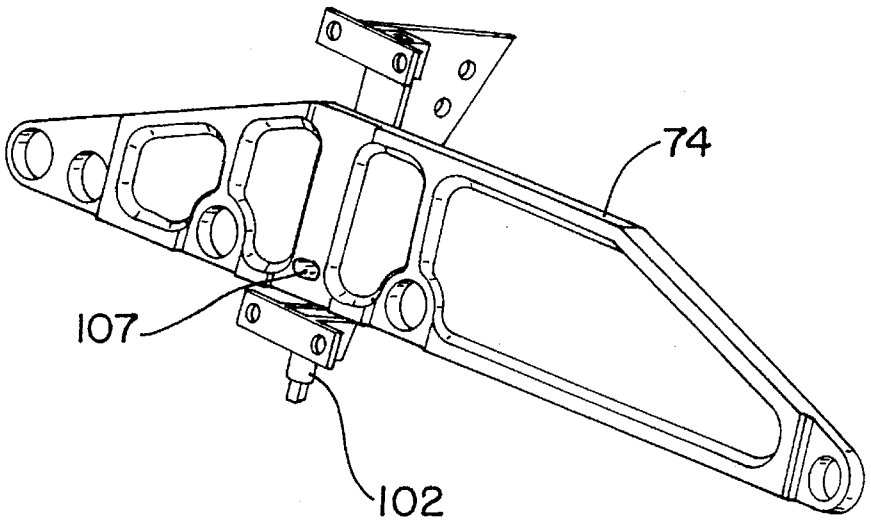
FIG. 6 (PRIOR ART)
FIG. 6 is a view substantially the same as the view depicted in FIG. 5 illustrating the prior art configuration.

FIG. 6 which is a partial plan view of the prior art mechanism and is included herein to contrast the current method with the heretofore method of rigging the linkage system. In the heretofore method the radial holes 109 and 107 (only the upper hole in the slider bracket is in view) on the slider bracket 80 and the pumphandle 74, respectively, are aligned. (The rigging holes 107 and 109 are shown in FIGS. 3 and 4 for illustration purposes as they no longer serve any useful purpose and hence, can be eliminated in accordance with this invention). A rigging pin (not shown) is temporarily placed through the holes to hold the pumphandle in place. The stop screw 102 which is threadably supported, is adjusted to contact with the pumphandle and is locked down with a jam nut. The pin is then removed. The external bellcrank is then secured to the internal bellcrank. Since the pumphandle is connected to the internal bellcrank and is free to move from the stop while being connected, the pumphandle will be in a new position away from the stop. Next, the external bellcrank is torqued until the pumphandle contacts the set screw 102. Finally, the actuator clevis is then turned until it aligns with the external bellcrank (the actuator being fully retracted) and then bolted in place.

As will be appreciated from the foregoing, when the rigging pin is placed in the pumphandle rigging hole and the rigging hole of the slider bracket which is attached to the compressor case, it positions the pumphandle in a fixed position relative to the compressor case. The heretofore understanding was that when rigging the variable vanes, adjustments to pumphandle running position are made. This is a misconception. The only adjustments that are made are to position the stop screw to contact the pumphandle in this rigged (open) position. As a result typical errors were made during assembly by using the wrong size rigging pin, overtorquing the stop screw, not contacting the pumphandle with the stop screw, over-torquing the external bellcrank and a series of other mistakes which resulted in misscheduling of the variable vanes.

This invention eliminates this complex assembly procedure and the human errors that were incidental thereto. Additionally, the invention eliminates the wear/yielding problem by making the width of the machined hard stop 100 large enough so that contact stresses are well within acceptable limits for both the pumphandle and slider bracket.

Although this invention has been shown and described with respect to detailed embodiments thereof, it will be appreciated and understood by those skilled in the art that various changes in form and detail thereof may be made without departing from the spirit and scope of the claimed invention.

I claim:

1. The method of assembling a rigless variable vane system to a compressor section encased in a gas turbine engine which is independent of a linear actuator and external connections of the system and adjusting the system so that vanes in the compressor section are always in a given position for all positions of the linear actuator including the steps of:

providing a case for the gas turbine engine, the vanes of the compressor section comprising variable area vanes movable to a full opened position in said case;

providing the linear actuator with an adjustable stop to limit the travel thereof;

providing a pumphandle and pumphandle slider bracket and attaching the pumphandle slider bracket to the case;

providing a bellcrank and connecting the pumphandle to the variable area vanes;

providing a stop having a contact surface on the pumphandle slider bracket that engages the pumphandle;

adjusting the pumphandle relative to the stop provided in the next above step so that the variable area vanes are in the full opened position when the pumphandle is in contact with the stop;

connecting the linear actuator to the bellcrank when the variable vanes are in the full opened position;

adjusting the adjustable stop of the linear actuator so that the stop on the linear actuator and the stop on the slider bracket are in synchronous relationship relative to each other; and machining the stop directly on the pumphandle slider bracket to assure that the stop on the linear actuator and the stop on the slider bracket are in synchronous relationship relative to each other.

2. The method as claimed in claim 1 including the step of hard coating the contact surface of the stop on the pumphandle slider bracket.

3. The method as claimed in claim 2 including the steps of;

providing a synchronizing ring and providing drive links connecting each of the variable vanes to the synchronizing ring, and connecting the pumphandle to the synchronizing ring.

4. The method as claimed in claim 1 including the step of machining the stop integral with the pumphandle slider bracket.

5. The method as claimed in claim 4 including the step of coating the contact surface of the stop with a hard metallic material.

6. Apparatus for a rigless variable vane system for an axial flow gas turbine engine having a compression section including variable vanes movable to a full opened position mounted in a compressor case of the compression section including a pumphandle and a pumphandle slider bracket attached to said compressor case and an actuator having actuator stop means for positioning said variable vanes by positioning said pumphandle as limited by said actuator stop means, the improvement comprising stop means integrally formed on said pumphandle slider bracket for engaging said pumphandle when said variable vanes are in the full opened position and when said actuator stop means limits the travel of said actuator.

7. Apparatus as claimed in claim 6 wherein said stop means is machined in situ on said pumphandle slider bracket.

8. Apparatus as claimed in claim 7 wherein said stop means is hard coated with a hard metallic material.

9. Apparatus as claimed in claim 8 wherein said hard metallic material is taken from the group consisting of chrome, nickel and the alloys thereof.

10. Apparatus as claimed in claim 8 wherein said actuator is linear and said variable vane system includes a synchronizing ring operatively connected to said pumphandle, said synchronizing ring encircling said compressor case, an internal bellcrank operatively connected to said pumphandle, an external bellcrank disposed between said internal bellcrank and said linear actuator for positioning said pumphandle to move rectilinearly relative to said pumphandle slider bracket and said synchronizing ring in a circumferential direction, and a plurality of drive links interconnecting said synchronizing ring and each of said vanes in said variable vane system whereby the position of said vanes is a function of the position of said linear actuator.

* * * * *